US011808018B2

(12) United States Patent
Nagata et al.

(10) Patent No.: US 11,808,018 B2
(45) Date of Patent: Nov. 7, 2023

(54) BUCKET TOOTH ADAPTER, BUCKET TOOTH ATTACHMENT STRUCTURE, AND BUCKET

(71) Applicant: KOMATSU LTD., Tokyo (JP)

(72) Inventors: Takanori Nagata, Tokyo (JP); Daijirou Tanaka, Tokyo (JP); Yudai Furudate, Tokyo (JP); Tatsuo Aira, Tokyo (JP); Monta Kondou, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 17/639,047

(22) PCT Filed: Sep. 9, 2020

(86) PCT No.: PCT/JP2020/034178
§ 371 (c)(1),
(2) Date: Feb. 28, 2022

(87) PCT Pub. No.: WO2021/049547
PCT Pub. Date: Mar. 18, 2021

(65) Prior Publication Data

US 2022/0290412 A1 Sep. 15, 2022

(30) Foreign Application Priority Data

Sep. 13, 2019 (JP) ..... 2019-167279

(51) Int. Cl.
*E02F 9/28* (2006.01)

(52) U.S. Cl.
CPC ..... *E02F 9/2825* (2013.01); *E02F 9/2833* (2013.01)

(58) Field of Classification Search
CPC ..... E02F 9/2825; E02F 9/2858
See application file for complete search history.

(56) References Cited

U.S. PATENT DOCUMENTS 1,834,514 A * 12/1931 Brune ..... E02F 9/2825 37/456
2,435,846 A * 2/1948 Robertson ..... E02F 9/2833 37/456
5,561,925 A * 10/1996 Livesay ..... E02F 9/2825 37/457

(Continued)

FOREIGN PATENT DOCUMENTS

CN 104343146 A 2/2015
JP 2004-68593 A 3/2004

(Continued)

OTHER PUBLICATIONS

Examination Report for the corresponding Indian application No. 202217015802, dated Jul. 20, 2022.

(Continued)

*Primary Examiner* — Gary S Hartmann
(74) *Attorney, Agent, or Firm* — Global IP Counselors, LLP

(57) ABSTRACT

A bucket tooth adapter for a bucket includes a mounting portion and a nose portion extending from the mounting portion. The mounting portion includes a first body portion and a wide portion. The wide portion is wider than the first body portion and is provided between the first body portion and the nose portion.

15 Claims, 5 Drawing Sheets

(56) References Cited

U.S. PATENT DOCUMENTS

| | | | | |
|---|---|---|---|---|
| 6,393,739 | B1 | 5/2002 | Shamblin et al. | |
| 8,434,248 | B2 * | 5/2013 | Woerman | E02F 9/2833 37/456 |
| 9,617,718 | B2 * | 4/2017 | Tanaka | E02F 9/2825 |
| 11,598,074 | B2 * | 3/2023 | Nagata | E02F 9/2833 |
| 2004/0025381 | A1 | 2/2004 | Cox et al. | |
| 2013/0086825 | A1 | 4/2013 | Renski et al. | |
| 2013/0086826 | A1 | 4/2013 | Renski et al. | |
| 2013/0174453 | A1 | 4/2013 | Cheyne et al. | |
| 2015/0033593 | A1 * | 2/2015 | Watanabe | E02F 3/40 37/444 |
| 2020/0157780 | A1 * | 5/2020 | Sinn | E02F 9/2825 |
| 2022/0098836 | A1 * | 3/2022 | Bilal | E02F 9/2825 |
| 2022/0298758 | A1 * | 9/2022 | Nagata | E02F 9/2841 |

FOREIGN PATENT DOCUMENTS

| | | | |
|---|---|---|---|
| JP | 2007-9631 | A | 1/2007 |
| JP | 2014-520983 | A | 8/2014 |
| JP | 2014-531546 | A | 11/2014 |
| JP | 2014-533331 | A | 12/2014 |

OTHER PUBLICATIONS

The Office Action for the corresponding Japanese divisional application No. 2022-179317, dated May 23, 2023.
The International Search Report for the corresponding international application No. PCT/JP2020/034178, dated Dec. 1, 2020.

* cited by examiner

BUCKET TOOTH ADAPTER, BUCKET TOOTH ATTACHMENT STRUCTURE, AND BUCKET

CROSS-REFERENCE TO RELATED APPLICATIONS

This application is a U.S. National stage application of International Application No. PCT/JP2020/034178, filed on Sep. 9, 2020. This U.S. National stage application claims priority under 35 U.S.C. § 119(a) to Japanese Patent Application No. 2019-167279, filed in Japan on Sep. 13, 2019, the entire contents of which are hereby incorporated herein by reference.

BACKGROUND

Technical Field

The present invention relates to a bucket tooth adapter for a bucket, a bucket tooth attachment structure for a bucket and a bucket.

Background Information

As a prior art, JP2007-9631A (Japanese published unexamined patent application) discloses a bucket tooth attachment structure for a bucket. In a conventional bucket tooth attachment structure for the bucket, a bucket tooth adapter is mounted to a bucket via a welding material.

In the conventional bucket tooth attachment structure for the bucket, a fillet welding is used in order to mount the bucket tooth adapter to the bucket. In case that there is a small level difference between a edge plate of the bucket and the bucket tooth adapter, a throat thickness of the fillet welding becomes small at a welding end of the fillet welding. For example, generally, the welding end, which is provided on a tooth side in the fillet welding, is formed in a spire shape. Thus, there is a problem that stress concentration generates at a tip of the welding end when an excavating work and a penetrating work is repeatedly performed with the bucket.

Also, the welding end wears because earth and sand slides on the welding end when an excavating work and a penetrating work is performed with the bucket. Thus, a crack may generate at a tip of the welding end when an excavating work and a penetrating work is repeatedly performed with the bucket.

An object of the present invention is to provide a bucket tooth adapter for a bucket which can stably maintain a mounting state to a bucket. Also, an object of the present invention is to provide a bucket tooth attachment structure for a bucket and a bucket which includes the bucket tooth adapter for the bucket.

SUMMARY OF THE INVENTION

A bucket tooth adapter for a bucket according to a first aspect includes a mounting portion and a nose portion extending from the mounting portion. The mounting portion includes a first body portion and a wide portion. The wide portion is formed so as to be wider than the first body portion and is provided between the first body portion and the nose portion.

A bucket tooth adapter for a bucket of the present invention can stably maintain a mounting state with respect to a bucket. Also, a bucket tooth attachment structure for a bucket and a bucket of the present invention can obtain the same effect as the bucket tooth adapter.

DESCRIPTION OF EMBODIMENTS

Figure 1:
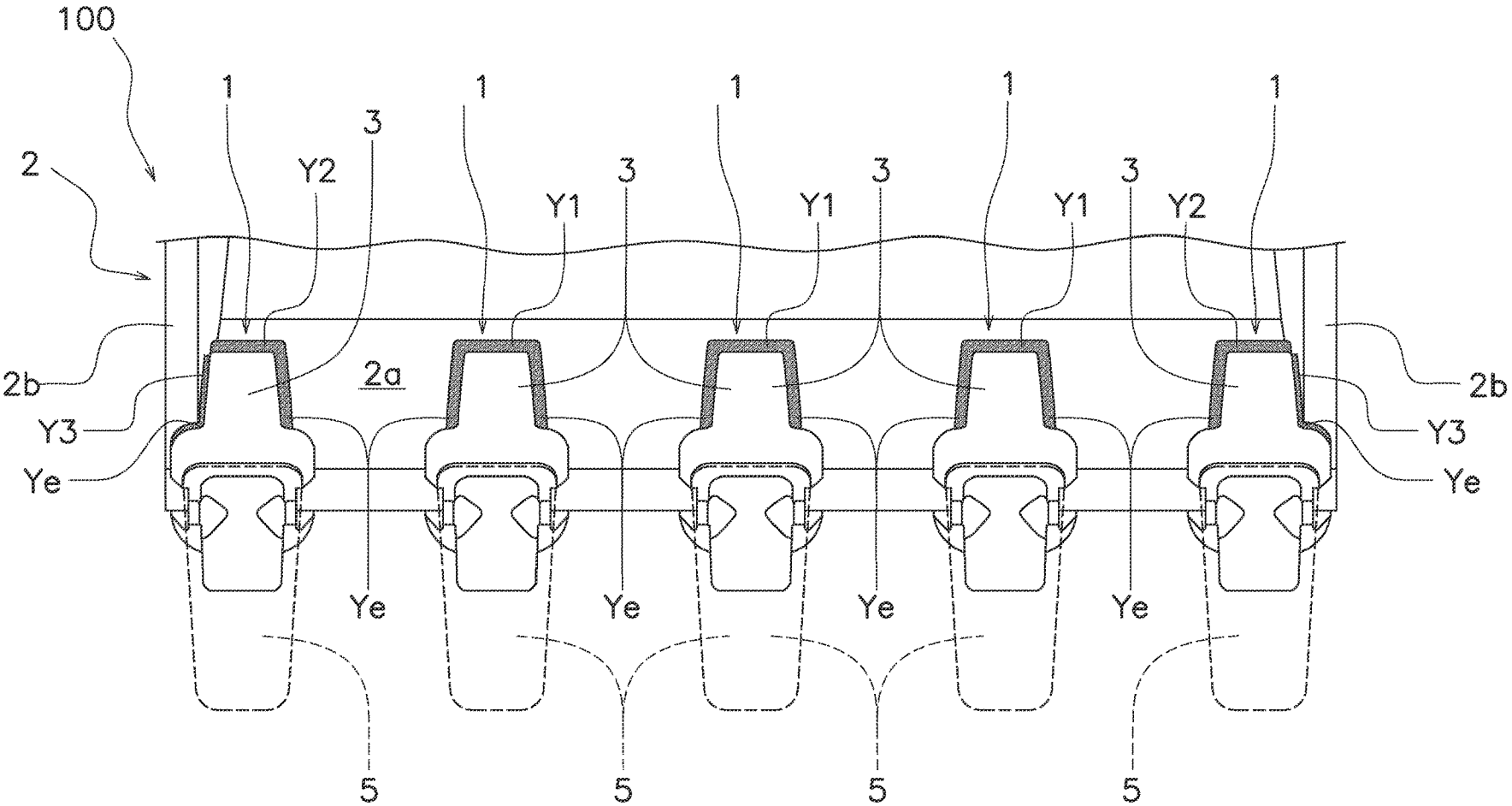
FIG. 1 is a top view of a bucket tooth attachment structure for a bucket according to an embodiment.

Configuration of a bucket 100 according to this embodiment will be described with reference to drawings. The bucket 100 includes a bucket tooth attachment structure 1 for the bucket 100 and a bucket body 2. For example, as shown in FIG. 1, the bucket tooth attachment structure 1 for the bucket 100 is mounted on the bucket body 2. For example, a plurality of bucket tooth attachment structures 1 are mounted on the bucket body 2. Each of the plurality of bucket tooth attachment structures 1 includes a bucket tooth adapter 3 and a tooth 5. In FIG. 1, the tooth 5 is shown by a broken line.

(Bucket Tooth Adapter)

Figure 2:
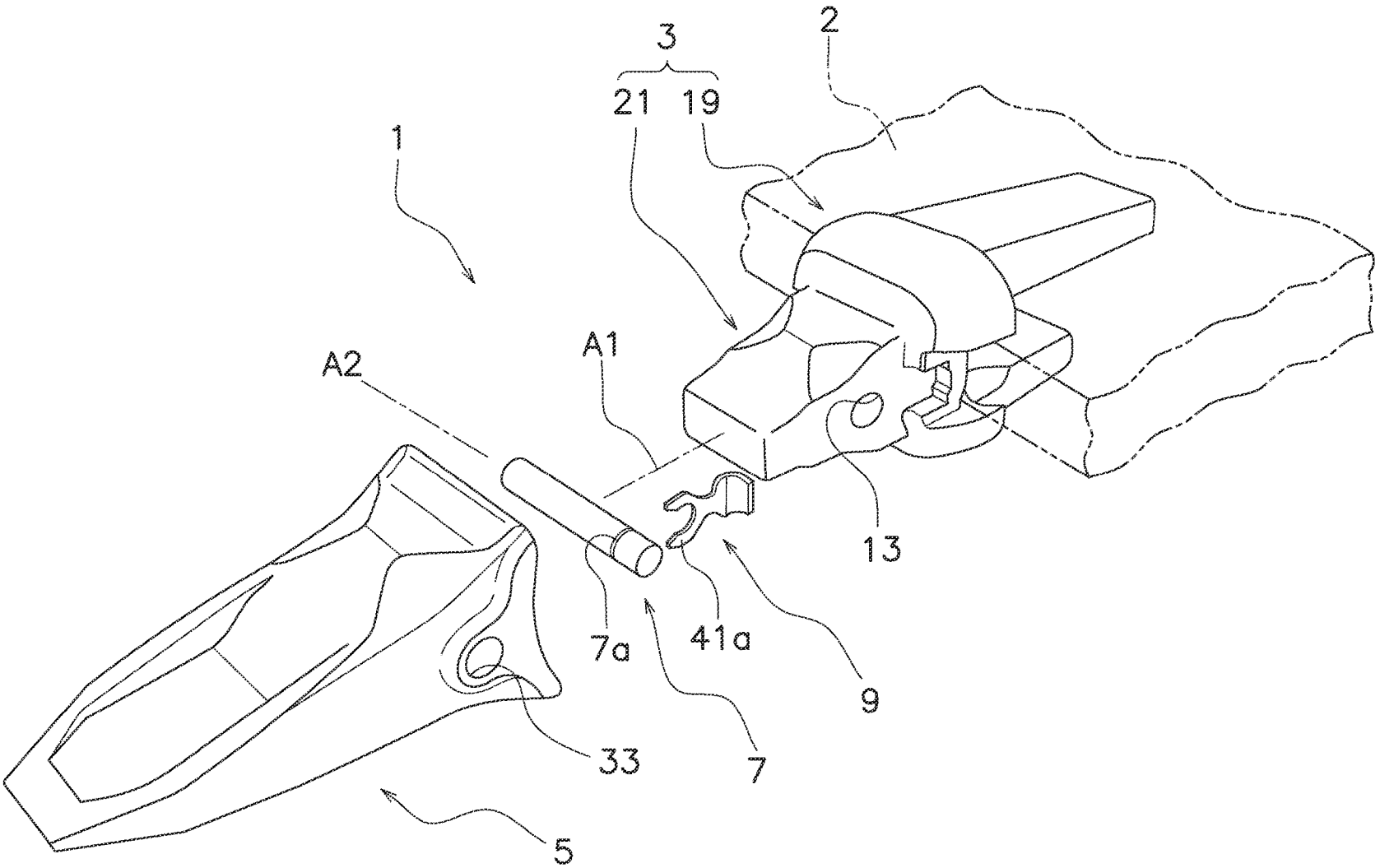
FIG. 2 is an exploded perspective view of the bucket tooth attachment structure of the embodiment.

As shown in FIG. 2, the bucket tooth adapter 3 is provided on the bucket body 2. The bucket tooth adapter 3 is mounted to the bucket body 2 so as to protrude from the bucket body 2. The bucket tooth adapter 3 is a member which is long in one direction. For example, as shown in FIG. 2, a longitudinal direction of the bucket tooth adapter 3 corresponds to a direction in which an axis A1 extends. The axis A1 corresponds to a longitudinal direction of a nose portion 21 (described later).

Figure 3:
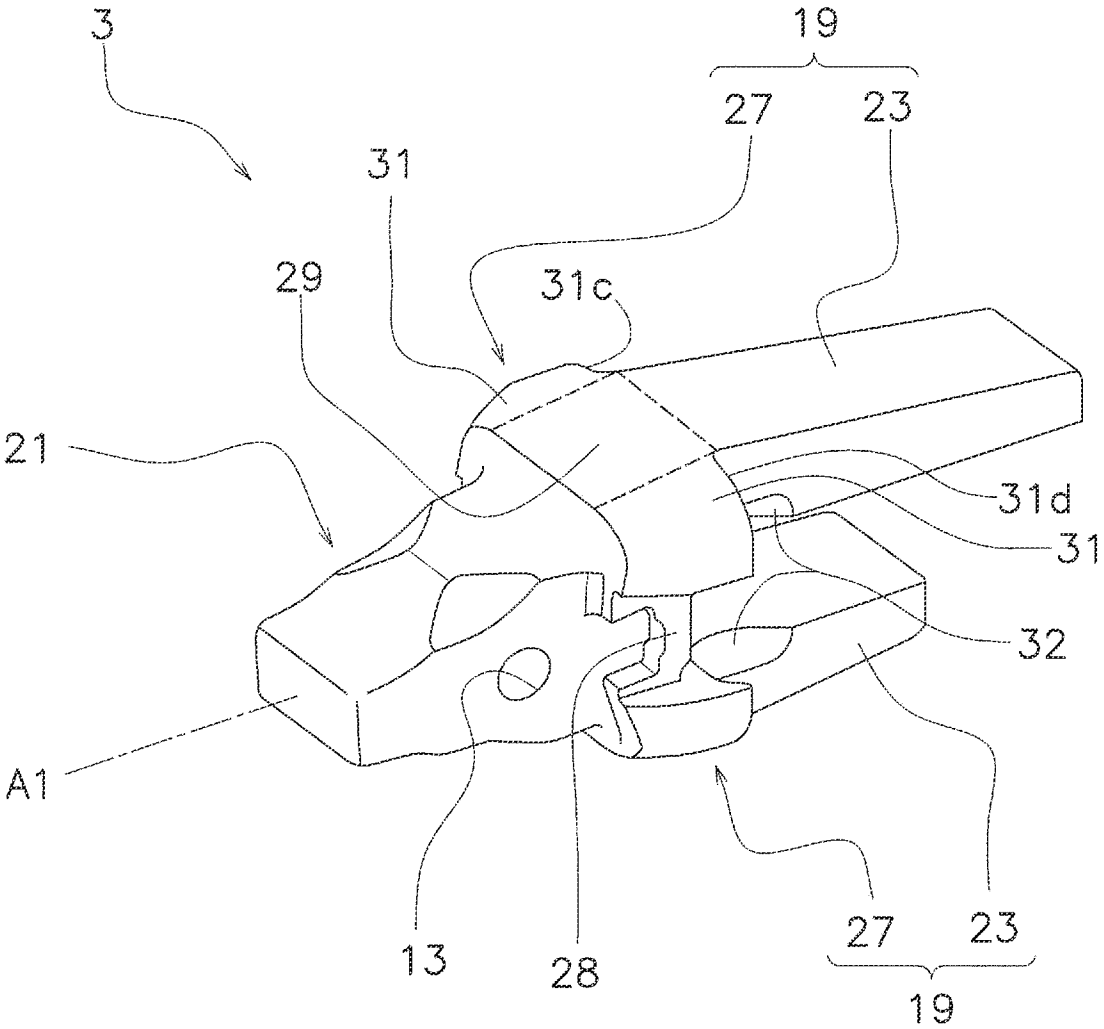
FIG. 3 is a perspective view for explaining a configuration of a bucket tooth adapter of the embodiment.

As shown in FIG. 3, the bucket tooth adapter 3 includes a mounting portion 19 and the nose portion 21. The mounting portion 19 is a portion which is mounted on the bucket body 2. The mounting portion 19 is fixed to the bucket body 2 by the welding materials Y1, Y2, and Y3 (see FIG. 1).

The mounting portion 19 includes a first body portion 23 and a wide portion 27. Specifically, the mounting portion 19 includes a pair of first body portions 23 and a pair of wide portions 27. The mounting portion 19 further includes a connecting portion 28 which connects the pair of wide portions 27.

The pair of first body portions 23 are disposed so as to be spaced apart from each other. A bottom plate 2*a* of the bucket body 2 is disposed between the pair of first body portions 23. Each of the pair of first body portions 23 extends from each of the pair of wide portions 27. For example, each of the pair of first body portions 23 extends from each of the pair of wide portions 27 in a direction opposite to a direction in which the nose portion 21 extends.

Figure 4A:
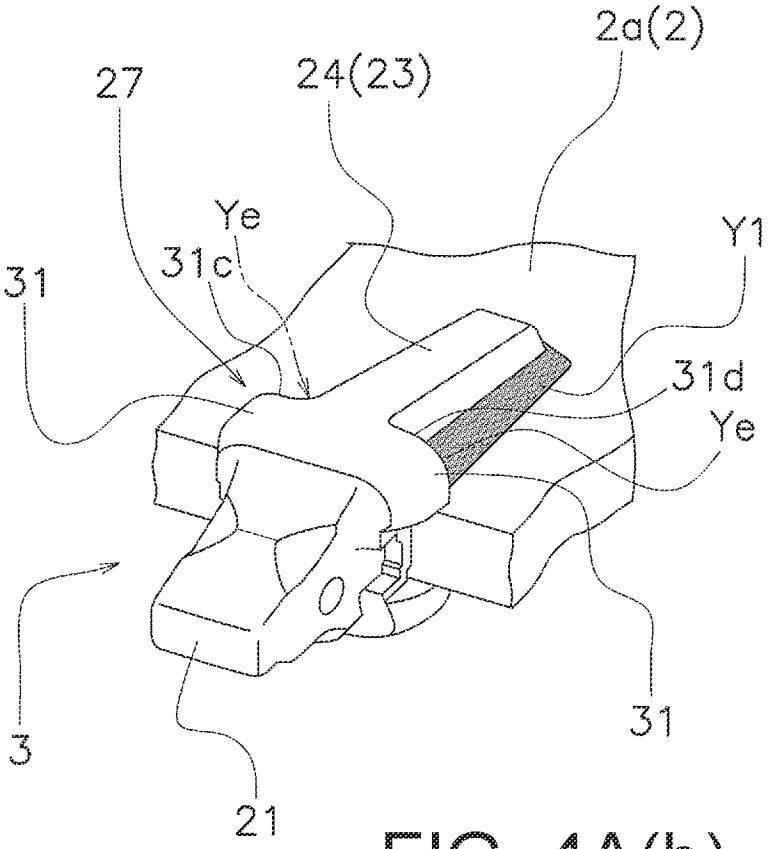
FIGS. 4A(a) and 4A(b) are perspective views of the bucket tooth adapter disposed at a position away from a side plate of the bucket of the embodiment.
Figure 4A:
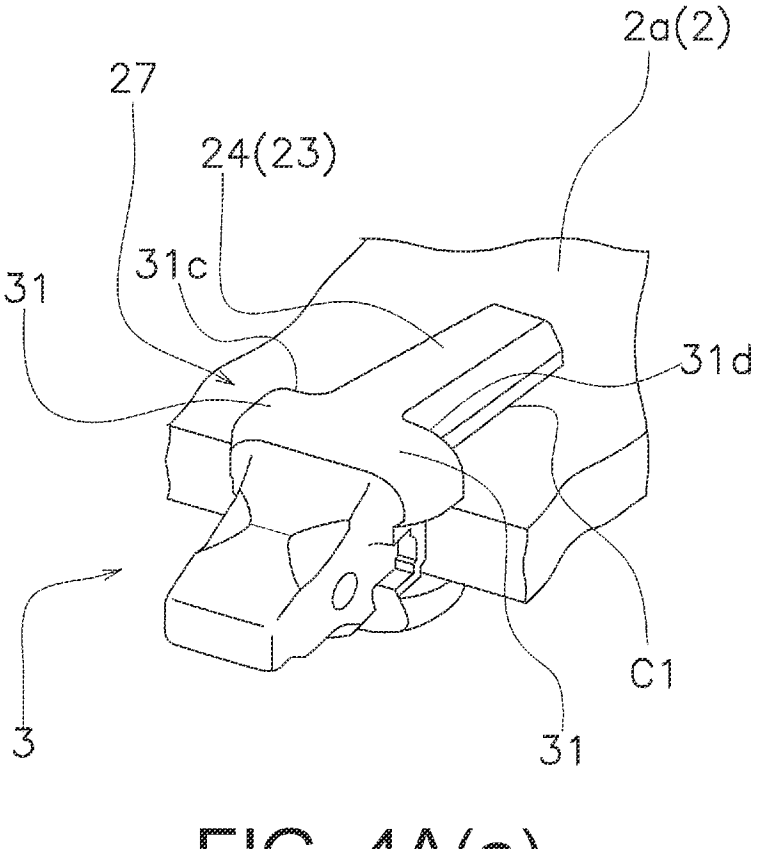
Figure 4B:
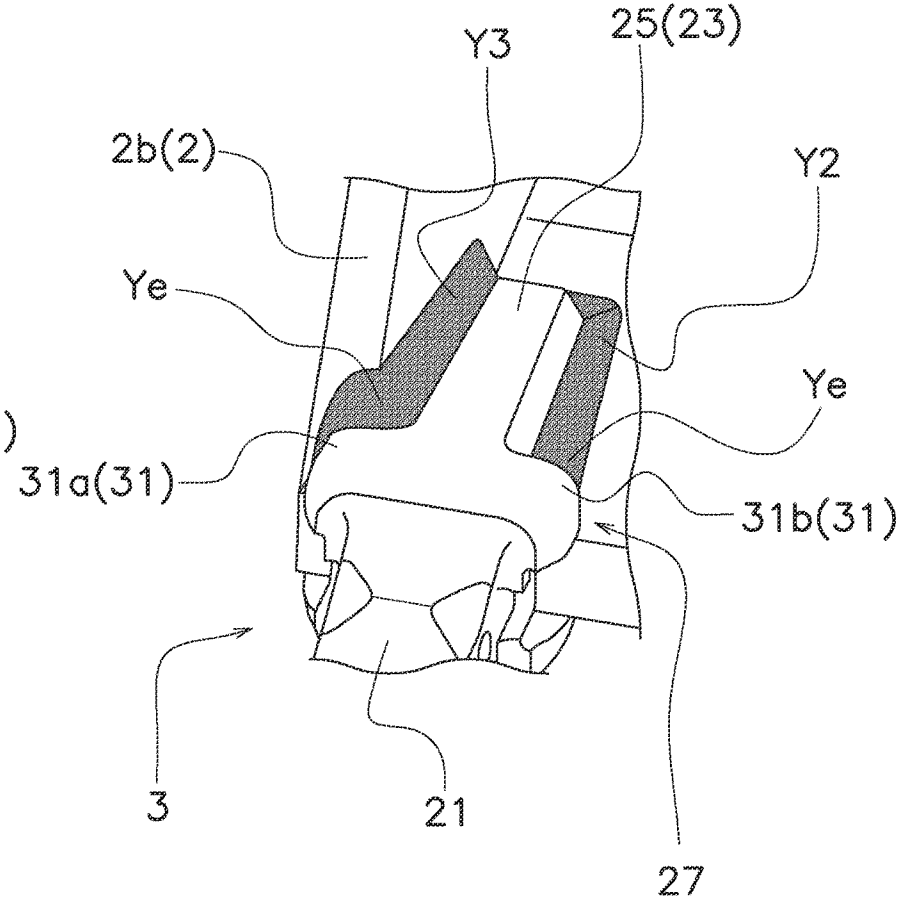
FIGS. 4B(a) and 4B(b) are perspective views of the bucket tooth adapter disposed at a position close to the side plate of the bucket of the embodiment.
Figure 4B:
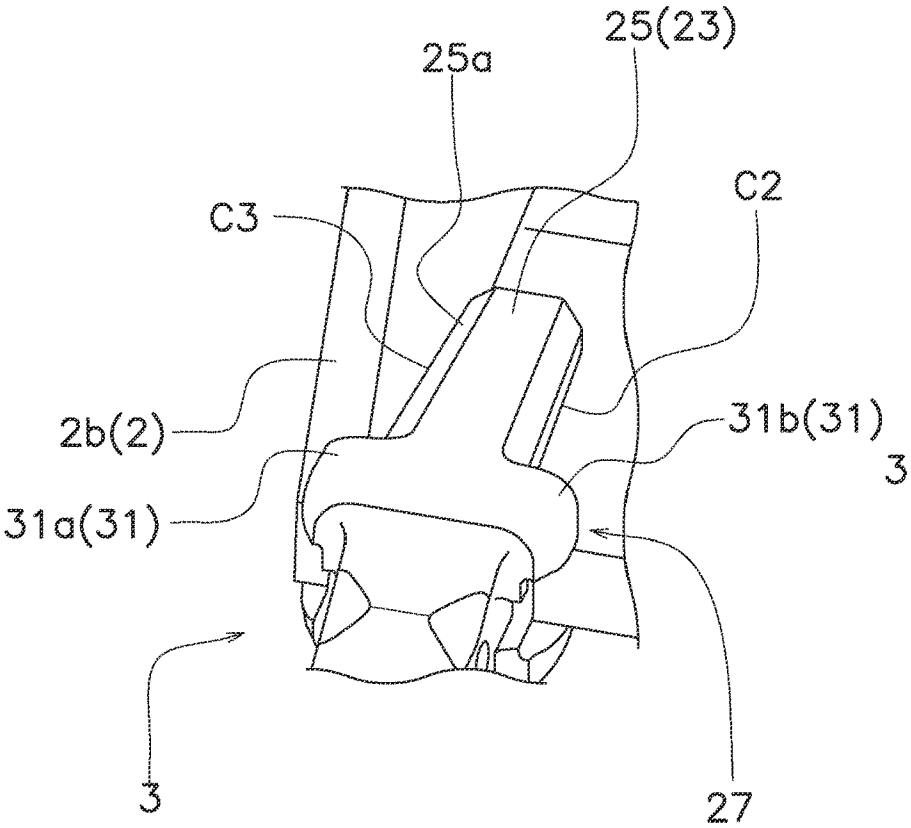

FIGS. 4A(a) and 4A(b) show the bucket tooth adapter 3 which is disposed at a position away from a side plate 2*b* of the bucket body 2. In this case, the first body portion 23 is followed by a reference numeral "24". FIGS. 4B(a) and 4B(b) show the bucket tooth adapter 3 which is disposed at a position close to the side plate 2*b* of the bucket body 2. In this case, the first body portion 23 is followed by the reference numeral "25".

As shown in FIG. 4A(a), the first body portion 24 is disposed on the bottom plate 2*a* of the bucket body 2, in case that the first body portion 24 is disposed at a position away from the side plate 2*b* of the bucket body 2. In this state, as shown in FIG. 4A(b), the welding material Y1 extending along a corner portion C1 (see FIG. 4A(a)) which is formed by the first body portion 24 and the bottom plate 2*a* of the bucket body 2. The first body portion 24 is fixed to the bottom plate 2*a* of the bucket body 2 by the welding material Y1 (see FIG. 1).

As shown in FIG. 4B(a), the first body portion 25 is disposed on the bottom plate 2*a* of the bucket body 2, in case that the first body portion 25 is disposed at a position close to the side plate 2*b* of the bucket body 2. In this state, as shown in FIG. 4B(b), the welding material Y2 extends along a corner portion C2 which is formed by the first body portion 25 and the bottom plate 2*a* of the bucket body 2. The first body portion 25 is fixed to the bottom plate 2*a* of the bucket body 2 by the welding material Y2 (see FIG. 1).

Also, as shown in FIG. 4B(a), a chamfered portion 25*a* is formed at a corner of the first body portion 25. In this case, as shown in FIG. 4B(b), the welding material Y3 extends along a corner portion C3 (a groove) which is formed by the chamfered portion 25*a* of the first body portion 25 and the side plate 2*b*. The first body portion 25 is fixed to the side plate 2*b* of the bucket body 2 by the welding material Y3 (see FIG. 1).

As shown in FIG. 3, the wide portion 27 is formed so as to be wider than the first body portion 23. The wide portion 27 is provided between the first body portion 23 and the nose portion 21. The wide portion 27 is integrally formed with the first body portion 23 and nose portion 21. As shown in FIGS. 4A(b) and 4B(b), the welding materials Y1, Y2, and Y3 extends along the corner portions C1, C2, and C3 respectively and an end portion Ye of each of the welding materials Y1, Y2, and Y3 is welded on the wide portion 27. Thereby, the wide portion 27 is fixed to the bottom plate 2*a* of the bucket body 2.

Specifically, as shown in FIG. 3, the wide portion 27 includes a second body portion 29 and a protruding portion 31. The second body portion 29 is integrally formed with the first body portion 23. For example, the second body portion 29 is formed integrally with the first body portion 23 between the first body portion 23 and the nose portion 21.

The protruding portion 31 is a portion which protrudes from the second body portion 29. For example, the protruding portion 31 includes a pair of protruding portions 31. Each of the pair of protruding portions 31 protrudes from the second body portion 29. In other words, each of the pair of protruding portions 31 protrudes from the second body portion 29, when the bucket tooth adapter 3 is viewed from the outside in the longitudinal direction of the bucket tooth adapter 3 (an axial direction along the axis A1). Each of the pair of protruding portions 31 includes a plane 31*c* and 31*d*, respectively, provided on a side facing the first body portion 23, as shown in FIGS. 3, 4A(a) and 4A(b).

As shown in FIGS. 4A(b) and 4B(b), the protruding portion 31 is provided between the nose portion 21 and the welding materials Y1, Y2, and Y3. For example, the protruding portion 31 is provided between the nose portion 21 and the end portion Ye of each of the welding materials Y1, Y2, and Y3 in the longitudinal direction of the bucket tooth adapter 3. Specifically, the protruding portion 31 is provided between the tooth 5 and the end portion Ye of each of the welding materials Y1, Y2, and Y3 in the longitudinal direction of the bucket tooth adapter 3.

For example, as shown in FIGS. 4A(a) and 4A(b), the protruding portion 31 is disposed on the bottom plate 2*a* of the bucket body 2, in case that the first body portion 23 is disposed at a position away from the side plate 2*b* of the bucket body 2. In this state, as shown in FIGS. 1 and 4A(b), the end portion Ye of the welding material Y1 is welded to the protruding portion 31. Thereby, the protruding portion 31 is fixed to the bottom plate 2*a* of the bucket body 2 via the end portion Ye of the welding material Y1.

As shown in FIG. 4B(a), the pair of protruding portions 31*a* and 31*b* are disposed on the bottom plate 2*a* of the bucket body 2, in case that the first body portion 23 is disposed at a position close to the side plate 2*b* of the bucket body 2. The protruding portion 31*a* is disposed so as to face an end portion of the side plate 2*b* of the bucket body 2. Specifically, in this case, the protruding portion 31*a* is disposed so as to face the end portion of the side plate 2*b* of the bucket body 2 in the longitudinal direction of the bucket tooth adapter 3.

In this state, as shown in FIG. 4B(b), the end portion Ye of each of the welding materials Y2 and Y3 are respectively welded to the protruding portions 31*a* and 31*b*. Thereby, the protruding portions 31*a* and 31*b* are fixed to the bottom plate 2*a* and the side plate 2*b* of the bucket body 2 via the end portions Ye of the welding materials Y2 and Y3. Also, the protruding portions 31*a* is fixed to the end portion of the side plate 2*b* of the bucket 100 via the end portion Ye of the welding material Y3.

FIGS. 4A(b) and 4B(b) show welding of an upper surface of the bottom plate 2*a* of the bucket body 2. Welding of a lower surface of the bottom plate 2*a* of the bucket body 2 is performed in the same manner as the welding material Y1 shown in FIG. 4A(b).

As shown in FIG. 3, a recess portion 32, which accommodates the end portion Ye of each of the welding materials Y1, Y2, and Y3, is formed on at least one of the first body portion 23 and the wide portion 27. In the present embodiment, the recess portion 32 is formed in the first body portion 23 and the wide portion 27. A throat thickness of the end portion Ye of each of the welding materials Y1, Y2, and Y3 can be increased by forming the recess portion 32 in this way.

As shown in FIG. 3, the nose portion 21 extends from the mounting portion 19. For example, the nose portion 21 is integrally formed with the mounting portion 19. The nose portion 21 extends from the mounting portion 19 so as to be away from the bucket body 2. The nose portion 21 is formed in a tapered shape. The nose portion 21 is a member that is long in one direction. The longitudinal direction of the nose portion 21 corresponds to a direction in which the axis A1 extends. For example, when a front end surface of the nose portion 21 is viewed from the outside, the axis A1 passes through a center of a tip portion of the nose portion 21 and a center of gravity of the nose portion 21. The first pin hole 13 is formed on the nose portion 21. The first pin hole 13 extends in a direction orthogonal to the axis A1 of the bucket tooth adapter 3. A pin member 7 is disposed in the first pin hole 13.

As shown in FIG. 3, the connecting portion 28 connects a pair of second body portions 29 to each other. The connecting portion 28 is integrally formed with the pair of second body portions 29. The connecting portion 28 is integrally formed with the nose portion 21. The connecting portion 28 is disposed so as to face the end portion of the bottom plate 2*a* of the bucket body 2. Specifically, the connecting portion 28 is disposed so as to face the end portion of the bottom plate 2*a* of the bucket body 2 in the longitudinal direction of the bucket tooth adapter 3.

(Tooth)

As shown in FIG. 2, the tooth 5 is mounted to the bucket tooth adapter 3. For example, the tooth 5 is mounted to the nose portion 21 of the bucket tooth adapter 3. Specifically, the tooth 5 is mounted to the nose portion 21 of the bucket tooth adapter 3 via the pin member 7. In this state, the tooth 5 is disposed to face the wide portion 27. Specifically, a base end of the tooth 5 is disposed to face the wide portion 27 in the longitudinal direction of the bucket tooth adapter 3.

A second pin hole 33 is provided on the tooth 5. The second pin hole 33 is formed so as to communicate with the first pin hole 13. A pin member 7 is disposed in the second pin hole 33. The pin member 7 connects the bucket tooth adapter 3 and the tooth 5. The pin member 7 is disposed in the first pin hole 13 and the second pin hole 33. The pin member 7 includes an annular groove 7*a*. The annular groove 7*a* is disposed between the bucket tooth adapter 3 and the tooth 5. A lock member 9 (described later) is engaged with the annular groove 7*a*. Specifically, the engaging portion 41*a* (described later) of the lock member 9 engages with the annular groove 7*a*.

As shown in FIG. 2, the lock member 9 is for locking the pin member 7. The lock member 9 is disposed between the bucket tooth adapter 3 and the tooth 5. The lock member 9 includes the engaging portion 41*a*. The engaging portion 41*a* is a portion that engages with the pin member 7. The engaging portion 41*a* includes a C-shaped inner peripheral surface. The engaging portion 41*a* is fitted into the annular groove 7*a* of the pin member 7.

For example, the engaging portion 41*a* of the lock member 9 is fitted into the annular groove 7*a* of the pin member 7 by sliding the lock member 9 toward the pin member 7, in a state where the lock member 9 is disposed between the bucket tooth adapter 3 and the tooth 5. Thereby, the tooth 5 is mounted to the bucket tooth adapter 3.

The bucket tooth adapter 3 includes the wide portion 27. The wide portion 27 is formed so as to be wider than the first body portion 23 in a state where the wide portion 27 is provided between the first body portion 23 and the nose portion 21. In this state, the end portion Ye of each of the welding materials Y1, Y2, and Y3 extending along the corners C1, C2, and C3 of the first body portion 23 and the bucket body 2 is welded to the wide portion 27.

In this configuration, the end portion Ye of each of the welding materials Y1, Y2, and Y3 can be abutted to the wide portion 27. Thereby, the throat thickness of the end portion Ye of each of the welding materials Y1, Y2, and Y3 can be sufficiently secured. In other words, occurrence of stress concentration can be suppressed at the end portion Ye of each of the welding materials Y1, Y2, and Y3. Also, earth and sand, which proceeds over the tooth 5 and toward the welding materials Y1, Y2, and Y3, can be prevented by the wide portion 27. In other words, wear of the end portion Ye of each of the welding materials Y1, Y2, and Y3, which generates due to earth and sand, can be prevented by the wide portion 27.

Thus, the bucket tooth adapter 3 can suppress the occurrence of the stress concentration at the end portion Ye of each of the welding materials Y1, Y2 and Y3 and can prevent the wear of the end portion Ye of each of the welding materials Y1, Y2 and Y3. In other words, the bucket tooth adapter 3 can stably maintain a mounted state with respect to the bucket body 2.

Also, the end portion Ye of each of the welding materials Y1, Y2, and Y3 are directly welded to the wide portion 27 on the bucket tooth adapter 3.

Thereby, the bucket tooth adapter 3 can be easily mounted to the bucket body 2, because a polishing work, in which the end portion Ye of each of the welding materials Y1, Y2, and Y3 is shaped, is not required.

Also, wear of the end portion of the side plate 2*b* due to earth and sand can be suppressed by the tooth 5 and the protruding portion 31*a*, in case that the bucket tooth adapter 3 (the first body portion 23) is disposed at a position close to the side plate 2*b* of the bucket body 2.

Also, the bucket tooth attachment structure 1 and the bucket 100 can obtain the same effect as the bucket tooth adapter 3, because the bucket tooth attachment structure 1 and the bucket 100 include the bucket tooth adapter 3.

Although one embodiment of the present invention is described, the present invention is not limited to the above embodiment, and various variations can be made without departing from the scope of the invention.

In the above embodiment, an example is shown in which the lock member 9 locks the pin member 7. A lock of the pin member 7 can be achieved by the other configuration. For example, the pin member 7 can be locked with an engaging member such as a retainer.

In the above embodiment, an example is shown in which the recess portion 32 is formed on the first body portion 23 and the wide portion 27. The recess portion 32 can be formed on one of the first body portion 23 and the wide portion 27.

According to the present invention, the mounting state with respect to the bucket can be stably maintained.

What is claimed is:

1. A bucket tooth adapter for a bucket comprising:

a mounting portion; and a nose portion extending from the mounting portion;

the mounting portion including a first body portion and a wide portion provided between the first body portion and the nose portion, the wide portion being wider than the first body portion, the wide portion including a second body portion integrally formed with the first body portion and a pair of protruding portion protruding from the second body portion, each of the pair of protruding portions including a plane provided on a side facing the first body portion, each of the planes being substantially perpendicular to a longitudinal axis of the nose portion, the plane of one of the pair of protruding portions extending from the first body portion in a first width direction, and the plane of another of the pair of protruding portions extending from the first body portion in a second width direction.

2. The bucket tooth adapter for the bucket according to claim 1, wherein the pair of protruding portions are provided between a welding material extending along the first body portion and the nose portion.

3. The bucket tooth adapter for the bucket according to claim 1, wherein the pair of protruding portions are configured to be disposed on a bottom plate of the bucket.

4. The bucket tooth adapter for the bucket according to claim 1, wherein one of the pair of protruding portions is configured to be disposed on a bottom plate of the bucket, and the other of the pair of protruding portions is configured to be disposed on the bottom plate of the bucket and faces an end portion of a side plate of the bucket, in a state where the first body portion is configured to be disposed adjacent to the side plate of the bucket.

5. The bucket tooth adapter for the bucket according to claim 1, wherein a recess portion is formed on at least one of the first body portion and the wide portion; and the recess portion accommodates an end portion of a welding material extending along the first body portion.

6. A bucket tooth attachment structure for a bucket comprising:

the bucket tooth adapter according to claim 1; and a tooth mounted to the nose portion of the bucket tooth adapter;

a base end of the tooth being disposed to face the wide portion of the bucket tooth adapter.

7. A bucket comprising:

the bucket tooth adapter according to claim 1.

8. The bucket tooth adapter for the bucket according to claim 2, wherein the pair of protruding portions are configured to be disposed on a bottom plate of the bucket.

9. The bucket tooth adapter for the bucket according to claim 8, wherein one of the pair of protruding portions is configured to be disposed disposed on a bottom plate of the bucket, and the other of the pair of protruding portions is configured to be disposed on the bottom plate of the bucket and faces an end portion of a side plate of the bucket, in a state where the first body portion is configured to be disposed adjacent to the side plate of the bucket.

10. The bucket tooth adapter for the bucket according to claim 9, wherein a recess portion is formed on at least one of the first body portion and the wide portion; and the recess portion accommodates an end portion of a welding material extending along the first body portion.

11. A bucket tooth attachment structure for a bucket comprising:

the bucket tooth adapter according to claim 10; and a tooth mounted to the nose portion of the bucket tooth adapter;

a base end of the tooth being disposed to face the wide portion of the bucket tooth adapter.

12. The bucket tooth adapter for the bucket according to claim 3, wherein one of the pair of protruding portions is configured to be disposed on a bottom plate of the bucket, and the other of the pair of protruding portions is configured to be disposed on the bottom plate of the bucket and faces an end portion of a side plate of the bucket, in a state where the first body portion is configured to be disposed adjacent to the side plate of the bucket.

13. The bucket tooth adapter for the bucket according to claim 12, wherein a recess portion is formed on at least one of the first body portion and the wide portion; and the recess portion accommodates an end portion of a welding material extending along the first body portion.

14. A bucket tooth attachment structure for a bucket comprising:

the bucket tooth adapter according to claim 13; and a tooth mounted to the nose portion of the bucket tooth adapter;

a base end of the tooth being disposed to face the wide portion of the bucket tooth adapter.

15. The bucket tooth adapter for the bucket according to claim 1, wherein the mounting portion includes a pair of wide portions.

* * * * *